US006244502B1

(12) United States Patent
Hollar et al.

(10) Patent No.: US 6,244,502 B1
(45) Date of Patent: Jun. 12, 2001

(54) SELF-DIVIDING BOX, COMPONENTS THEREOF, AND METHOD OF MANUFACTURING, ASSEMBLY AND DISASSEMBLING THE SAME

(75) Inventors: Mark Eugene Hollar; Daniel T. Bell, both of Houston, TX (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/363,392

(22) Filed: Jul. 29, 1999

(51) Int. Cl.[7] ..... B65D 5/48

(52) U.S. Cl. ..... 229/120.011; 229/117.16; 229/120.29; 229/120.33; 493/90; 493/912

(58) Field of Search ..... 229/120.011, 120.012, 229/117.16, 120.29, 120.33, 120.38; 493/90, 92, 912

(56) References Cited

U.S. PATENT DOCUMENTS

| | | | | |
|---|---|---|---|---|
| Re. 26,557 | * | 3/1969 | Houston | 229/120.33 |
| 2,012,132 | * | 8/1935 | Koppelman et al. | 229/120.38 |
| 2,284,385 | * | 5/1942 | Freshwaters | 229/117.16 |
| 2,663,491 | * | 12/1953 | Hill et al. | 229/117.16 |
| 2,710,130 | * | 6/1955 | Grecco | 229/120.012 |
| 2,998,909 | * | 9/1961 | Anderson, Jr. et al. | 229/120.011 |
| 3,101,880 | | 8/1963 | Peterson . | |
| 3,330,467 | * | 7/1967 | Johnson | 229/117.16 |
| 4,303,405 | * | 12/1981 | Reichert | 493/90 |
| 4,757,938 | * | 7/1988 | Collins | 229/120.38 |
| 4,793,494 | | 12/1988 | Gordon, Jr. . | |
| 4,811,837 | * | 3/1989 | Larizza | 229/120.011 |
| 4,826,016 | * | 5/1989 | Foster | 229/120.011 |
| 4,919,269 | | 4/1990 | Wright et al. . | |
| 5,249,738 | | 10/1993 | Werth . | |
| 5,299,733 | | 4/1994 | Werth . | |
| 5,316,210 | * | 5/1994 | Scullin | 229/117.16 |
| 5,419,431 | | 5/1995 | Neuber et al. . | |
| 5,579,911 | | 12/1996 | Werth . | |
| 5,645,163 | | 7/1997 | Werth . | |
| 5,758,818 | | 6/1998 | Ewing, Jr. . | |

* cited by examiner

*Primary Examiner*—Gary E. Elkins
(74) *Attorney, Agent, or Firm*—Smith, Gambrell & Russell

(57) ABSTRACT

A dividable container that includes an outer container component having a bottom section, an intermediate section which includes two opposing side walls and two opposing end walls, and a top cover, the outer container having a perforation line which is positioned so as to extend about the opposing side walls, top section and bottom section so as to provide two sub-container components upon separation along the perforation line, and the side wall further including handle flap sections. The container also includes a first divider and a second divider, each of the dividers including a back wall, a pair of side panels spaced apart by the back wall and a bottom segment, the first divider having a back wall flush or essentially flush with the perforation line and a handle reception opening for reception of a handle flap from one of the handle flap sections, and the second divider having a back wall flush or nearly flush with the perforations and on an opposite side of the perforation line as that of said first divider, and the second divider includes a handle reception opening for reception of a handle flap from another of the handle flap sections. There is also described a method of forming the outer container component and an internal dividers and assembling these components so as to provide an easily dividable box. There is also described a method for separating the undivided box into its two sub-containers following interlocking the two components with the handle flaps.

24 Claims, 10 Drawing Sheets

A1
A2
A3
B1
B2
B3
C1
C2
C3
D1
D2
D3
E1
E2
E3
F1
F2
F3
G1
G2
W
L
R1
R2
20
22
22'
24
25
26
28
30
32
34
36
38
40
42
44
46
48
50
52
54
56
58 a1
a2
a3
e1
e2
e3
f1
f2
f3
g1
g2
W1
l
B3
C3
D3
25
26
30
31
42
44
56
58

FIG. 11
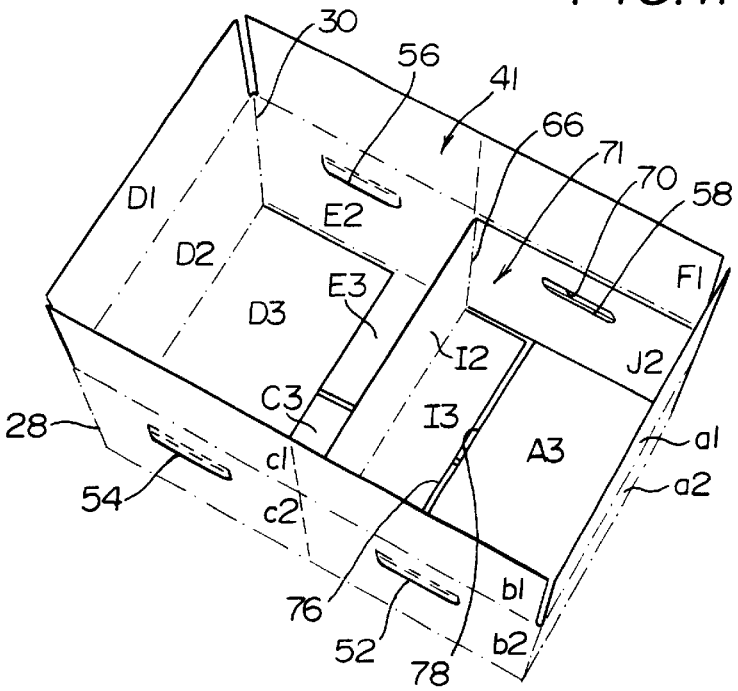
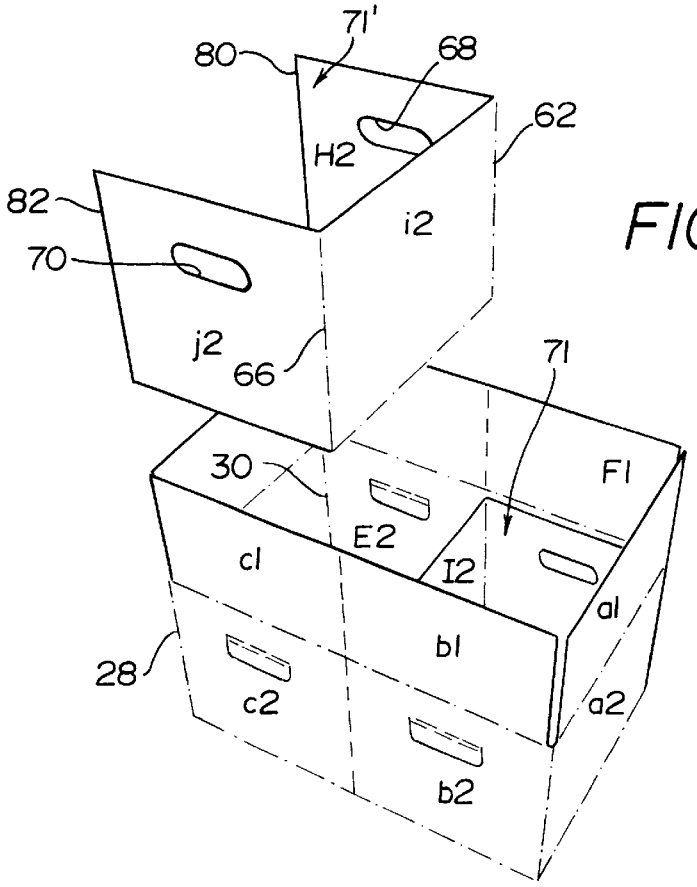
FIG. 12

SELF-DIVIDING BOX, COMPONENTS THEREOF, AND METHOD OF MANUFACTURING, ASSEMBLY AND DISASSEMBLING THE SAME

FIELD OF THE INVENTION

The present invention relates to a self dividing box or container used for shipping a plurality of articles, such as beverage containers, which can be easily divided into two separate, self contained and fully intact containers by, for example, a downstream recipient of the undivided container such as a distributor or customer of the product manufacturer. The present invention also relates to the components utilized in providing the self contained containers, the manufacturing of those components, the assembly of those components into a sealed container and the separation/dividing of the assembled, undivided container.

BACKGROUND OF THE INVENTION

While there is a wide variety of product distribution arrangements, it is often the case that an upstream manufacturer or wholesaler prefers, mainly from an efficiency standpoint, to ship out larger boxes or containers to the downstream recipients. The downstream recipients such as intermediate distributors, retailers or customers often, however, prefer to deal with smaller size containers for reasons such as easier handling, easier distribution or purchase in a more typical amount for that particular product. Many downstream distributors, retailers and customers also find it advantageous to have the option of being able to decide whether to stay with a larger undivided container or work with or purchase a smaller, divider container. This ease of handling and freedom of selection is particularly important in the beverage industry such as the sale of soda and beer.

U.S. Pat. No. 4,793,494 to Gordon Jr. provides an example of a prior art break-apart container that features an undivided container that is broken in half at the site of use such as a hospital. The Gordon Jr. container features an inner member that has an I-shaped cross-section and an outer cardboard wrapper that covers the open bottom and ends of the inner member. To join the inner member to the outer member, the exterior wrapper has flanges which are sealed about the entire periphery of the side walls of the inner member. The outer member has a central line of tearing which, in conjunction with an earlier or contemporaneous tearing of a central fold line of the inner member and a breaking of an inner member glue bond required to hold the inner member sections in proper position, provides for the separation of the sub-containers following removal of a shrink wrap covering. While describing enclosed sub-containers, the arrangement in Gordon Jr. involves a rather complicated assembly procedure involving a great deal of glue bonding amongst the various components making it not well suited for many manufacturers and their on-hand box erection equipment.

U.S. Pat. No. 4,919,269 to Wright et al describes a multiple compartment/separable container formed from a single piece of material. The single piece blank has a top panel with an exterior side wall panel, partial bottom wall panel, internal side wall panel and lap panel combination extending out from each side of the top panel. During assembly the panels within each compartment are arranged perpendicular to an adjacent panel with the lap panel curled under into adhesive contact with the underside of the top panel. The two adhered lap panels are separated by a central double perforation tear strip in the top panel. The non-connected side edges of the panels have extending from them a wide variety of different shaped panel extensions and bevel fold lines which are brought together to provide a fully enclosed container. Separation is achieved by ripping the top panel tear strip and relying on the respective adhesive lap joints adjacent the tear strip to maintain the individual sub-containers in assembled condition. As with Gordon Jr. noted above, the assembly requirements for the Wright et al. container involve highly specialized equipment and/or intensive manual labor and rather complex folding and adhesive steps.

U.S. Pat. No. 5,249,738 to Werth describes a package formed from a one piece blank that is subjected to a series of folding and adhesive steps to form a container that can be broken down from a case to either 12-pack or 6-pack size. In addition to leaving the products exposed, the nature of Werth's container is similar to Wright's described above from the standpoint of involving highly specialized equipment and rather complex folding and adhesive steps.

U.S. Pat. No. 5,419,431 to Neuber et al describes a separable container formed from a lower pair of partial containers which are placed in an end-to-end relationship and each have a plurality of side and top glue flaps. The container features a U-shaped covering body that has a central perforate split line and which is adhered to the various top and side flaps of the lower tray like bodies. As with the other prior art described above, the Neuber invention suffers from many of the same drawbacks described above including the reliance on highly specialized equipment and rather complex folding and adhesive steps.

U.S. Pat. No. 5,758,818 to Ewing, Jr. describes a dividable container which features two internal compartments formed from a single blank so as to have open top and bottoms. The two compartments are joined at either a top or bottom edge by a common fold which is perforated for ease in separation by a cutting device. Top and bottom tray like lids are provided to close off the open ends of the two internal compartments. These are adhered to the periphery of the open internal compartments through use of suitable adhesive. The top and bottom trays are provided with slits and perforations which are describes as helping to facilitate a blade cutting operation. This container is not particularly easy to separate, particularly with its emphasis on cutting blade usage, and like the prior art described above is also not well suited for many manufacturers box folding and erecting equipment and/or requires multiple types of equipment making for a longer assembly time due to for example numerous manual steps being involved for those facilities lacking the necessary equipment. Reference is also made in Ewing Jr. to the possibility of using tear strips such as that described above in Werth. This introduces the problem of waste material being produced during separation which retailers and the like would prefer to avoid (e.g., customers dividing a carton and leaving rip off strip in the sales area).

SUMMARY OF THE PRESENT INVENTION

The present invention is directed at providing a container that can easily be subdivided so as to provide two self contained preferably completely enclosed containers well suited for handling a wide range of product weights and sizes. In addition the present invention is designed for rapid assembly with a great deal of that assembly being well suited for standard box erecting equipment.

The assembled or ready-to-ship box of the present invention, with its two compartment arrangement, makes it easy to provide a size that is well suited for shipping to a downstream distributor, retailer or even directly to a customer with the recipient of the box having a variety of further handling options such as further distribution downstream in the closed, undivided state, opening the box while maintaining the undivided state for access to all contained products (e.g. 24 bottles or cans), dividing the box while maintaining the closed state for further distribution in a closed state wherein the downstream recipient opens the divided box or boxes received, or dividing and opening the boxes with the opening taking place either before or (more preferably after) splitting of the two box section. As can be seen, the versatility of the present invention makes it well suited for multiple uses and also avoids the problems of the prior art such as exposing compartments or weakening the box structure due to the splitting operation. For example, the ability to divide the box without exposing the contents is particularly useful to retailers in that retail handlers can more easily handle the weight of a divided box during activities such as shelving or stacking for display. Also, there are numerous situations where an opened full case can not be completely set out in a display or customer access area resulting in the return of an opened and weakened container to a back storage area where the products are more susceptible to damage or loss. The ability to divide up the full case while keeping one divided half unopened and fully protected and structurally intact allows a retailer to better accommodate display areas without the aforementioned environmental exposure problems. The self contained dividing ability also helps in the distribution of the appropriate number of products within a facility or defined region such as distribution of products in a hospital where there are certain products that require continuous replenishment (such as disposable products many of which are preferably left in closed containers as long as possible).

A preferred embodiment of the present invention also avoids the problem with some prior art designs in that separation can be achieved without leaving discarded material in the area of separation or hanging from a portion of the container. Although less desirable from the standpoint of added waste material and added complexity, the present invention can also feature separation means other than the preferred single perforation line such as, for example, tear strips or strings. Another advantage of the present invention is that there is avoided additional gluing requirements with respect to the inner member and outer box member which can in some prior art embodiments inadvertent glue contact and attachment with respect to the container and the product or different portions of the container not intended to be adhered. In the preferred embodiment of the invention, the interlocking of the inner and outer members is achieved when the handle flaps are moved into locking position which preferably occurs only when the person who is separating the compartments initiates separation. This provides for easy insertion of the inner divider member without a great deal of concern for exact positioning and the avoidance of an extra step of interlocking the inner divider members and/or a divider member with the outer box through the typical prior art procedure of using an adhesive.

The design of the present invention is also well suited for customer manipulation to purchase only what is desired without damage to the products not presently desired for purchase. For example, a customer may desire only a 12 pack of a beverage and not a full case. With the present invention, the customer can easily carry out the dividing process made easy by the design of the present application as described in greater detail below. Furthermore the dividing process will not only readily achieve the two divided box state, but it can achieve the same without undesirable damage to the divided boxes. In addition, because the dividing process provides a clean break without damage to one or the other divided boxes, it is well suited for having preprinted product logos, information etc, applied to all of the sections, so that upon splitting the two divided boxes appear self-contained rather than split apart. For example by providing indicia on the to be exposed face surfaces of the dividers, it is possible to have that indicia combine with that provided on the initially exposed surfaces on the undivided box to give the appearance of a self-contained divided box as opposed to merely a segment of a larger box structure.

Separation is accomplished, for example, by a person grasping the opened handles (which opening can be carried out during the grasping step and the grasping is preferably with respect to a pair of handle holes on a common side wall) and applying an opposite rotation force to at least initiate a ripping of the perforation tabs lines, with the rotation preferably being carried out together, at least at some point, with an outward tension applied on each side of the perforation lines to facilitate further ripping and separation with respect to the perforation lines Rotation along the perforation plane can however be solely relied upon with the arrangement of the present invention. Alternatively one of the two to-be-divided cartons can be manipulated while the other one is pushed down or otherwise held stationary.

The invention thus features a dividable container for storing articles, comprising an undivided outer container component having a top, bottom and an intermediate section, said intermediate section having separation facilitation means. The dividable container also includes a divider, said divider being positioned with respect to said separation facilitation means so as to form, upon separation of said undivided container along said separation facilitation means, a first sub-container that has an intermediate wall comprised of a first portion of said divider and a portion of said intermediate section. The undivided outer container component includes an engagement member which is adjustable from a non-engage state to an engage state, and said divider having an engagement member reception section, whereby said reception section is positioned so as to receive said engagement member while in said engage state so as to interlock said outer container component to said divider.

Preferably the first divider has a back wall in a flush or essentially flush arrangement on a first side of said separation facilitation means and said second divider having a back wall in a flush or essentially flush arrangement with respect to a second side of said separation facilitation means. The dividers have back walls that are flush and in contact with each other. Preferably there is a first divider and a second divider with said first and second dividers each include a back wall, two side walls and a bottom wall, and said undivided carton having two side walls forming a portion of said intermediate section, and said undivided container including a plurality of said engagement members for interlocking said dividers to said undivided outer container.

The engagement members preferably include a flap that is foldable though a reception openings formed in a juxtaposed one of said side walls of said dividers. Also, said back walls of said first and second dividers are preferably free from connection with one another, and the first and second dividers are in contact with comers of said intermediate section of said undivided container component. Moreover, said divider is in contact with said undivided outer container component but free from securement with said undivided outer container component.

Thus the invention features a dividable container, comprising an outer container component having a bottom section, an intermediate section which includes two opposing side walls and two opposing end walls, and a top cover, said outer container having a perforation line which is positioned so as to extend about the opposing side walls, top section and bottom section so as to provide two sub-container components upon separation along said perforation line, and said side wall further comprising handle flap sections. Also, there is provided a first divider and a second divider, each of said dividers including a back wall, a pair of side panels spaced apart by said back wall and a bottom segment, the first divider having a back wall flush or essentially flush with the perforation line and a handle reception opening for reception of a handle flap from one of said handle flap sections, and said second divider having a back wall flush or nearly flush with said perforations and on an opposite side of said perforation line as that of said first divider, and said second divider including a handle reception opening for reception of a handle flap from another of said handle flap sections.

In a preferred arrangement said dividers are free from securement with respect to said outer container when said handle flaps are not engaged. Also, said outer container is formed from a single blank having a plurality of top segments, intermediate segments and bottom segments separated by fold lines and cut-outs, and said perforation line extends from a top edge to a bottom edge of said blank across a vertically aligned set of one of said top, intermediate and bottom.

The invention also features an outer container component blank for use in a self-dividing container, said blank having a series of upper, intermediate and bottom segment sets, with said sets being separated by folds at the intermediate level and separated by cut-outs at the top and bottom level with said cut-outs being in vertical alignment with respective fold lines in said intermediate segments, and said intermediate level including handle flaps and said blank further comprising a perforation that extends across one of said sets. The intermediate segments include one glue tab segment at a free end of said blank. There is also a pair of perforations extending along parallel lines that are separated by at least one fold line in said blank. There is also preferably two pairs of handle flap sections in said blank separated by at least one fold line.

The invention further includes a method of assembling a self dividing box, comprising erecting an outer container component from a blank having a handle flap portion formed therein, such that the erected outer container component has an enclosed bottom, an interconnected intermediate section and an open top section, and said intermediate section having separation means. The method further includes inserting a divider having a bottom segment, back wall, a pair of side panels extending from said back wall and a flap reception opening such that the flap reception opening of said divider is placed in a handle flap reception position with respect to said handle flap portion.

The method also includes inserting a second divider having a bottom segment, back wall, a pair of side panels extending from said back wall and a flap reception opening such that the flap reception opening of said second divider is placed in a handle flap reception position with respect to a second flap portion of said blank, and said inserting of said second divider includes placing the back walls of said dividers in a flush relationship with the separation means being a perforation line aligned with flush back walls.

BRIEF DESCRIPTION OF THE DRAWINGS

FIG. 11 illustrates a divider being in its final resting position within the box.

FIG. 12 illustrates an initial stage of insertion of a second divider within the open box of FIG. 3.

DETAILED DESCRIPTION OF THE INVENTION

Figure 1:
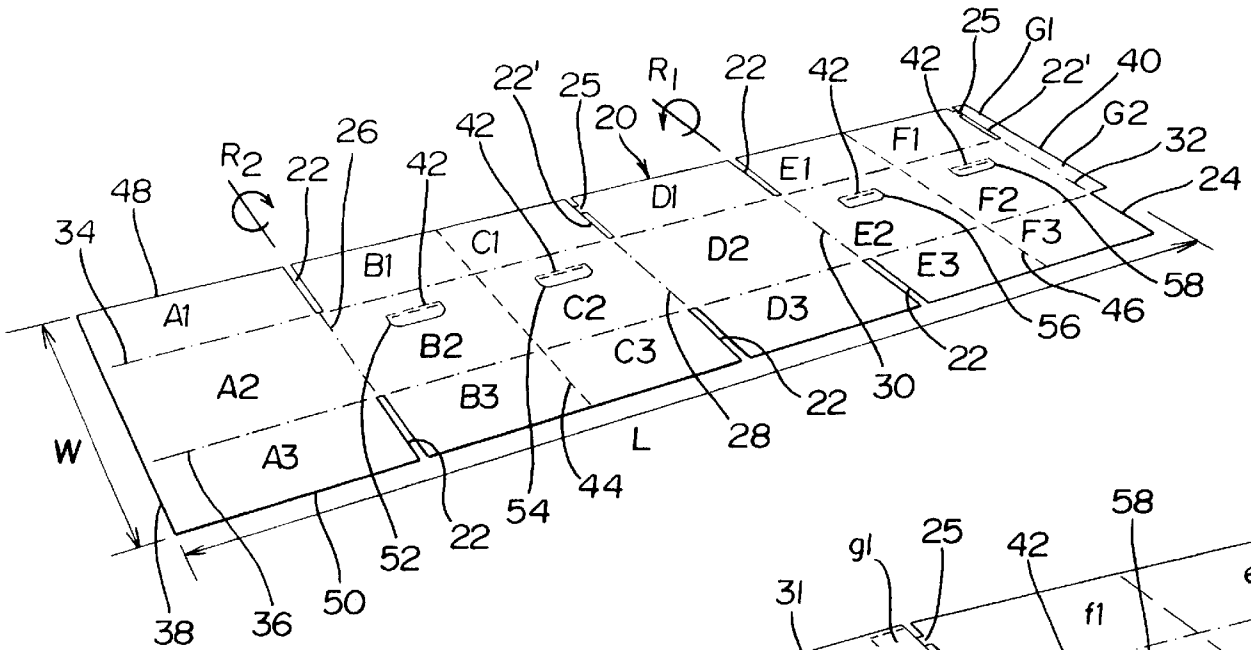
FIG. 1 illustrates a box blank of a preferred embodiment of the present invention.

FIG. 1 illustrates box blank 20 in a flat, unfolded state. Blank 20 is preferably formed out of a single piece of material having a pre-process length of L and width W which is subjected to a cutting process, a perforation formation process and a fold line formation process. The cutting process can be any conventional process for forming relatively smooth and accurate cuts. The cutting process is relied upon to form continuous cut-outs 22 and non-continuous cut-outs 22', with the latter defining connection tabs 25 which extend across the side walls defining non-continuous cut-out 22' at a location about 25% inward from the outer opening of cut-outs 22'.

The cutting process is also relied upon to provide cut-away edge section 24 which features a comer section of the original single piece of material that is completely removed. In addition, four U-shaped handle formation cut-outs 52, 54, 56 and 58 are formed in the material from which the blank 20 is formed. Alternatively, easily broken perforations can be provided to form the U-shaped handle formation cut-outs, although a clean cut is preferred for easy manipulation of the handle tabs defined by, for example, cut-out 52.

The single piece of material from which blank 20 is formed is preferably formed of a cardboard material such as a laminate of corrugated cardboard featuring an intermediate layer of fluted cardboard with kraft paper inner and outer wall surface facings, although other materials are possible. An example of a suitable corrugated cardboard includes 42# liner—26# medium—42# liner material. Another suitable corrugated cardboard material includes 69# liner—33# medium —49# liner material. Also, the use of "box" in the present invention is intended to be in broad sense and not limited to any particular material such as the more typical cardboard material associated with box. The word box in the present invention can be considered synonymous with "container" or the like.

In addition to the cutting process, blank 20 is also formed by subjecting the original single piece of material to a fold line formation process which includes, for example, subjecting the material to a corrugator (compression across the corrugation direction), press scores (scores traveling with the corrugation direction) and/or a cookie cutter like cutting die which does not result in material separation. The fold line locations in blank 20 are represented by dot-dash lines in the figures with FIG. 1 showing fold lines 26, 28 30 and 32. For ease of reference, fold lines 26, 28, 30 and 32 are hereafter referred to as "vertical" fold lines 26, 28, 30 and 32 as these fold lines are preferably arranged along the vertical in the resultant box 41 (FIG. 3) described below. Vertical fold lines 26 and 30 each extend between the interior ends of a respective pair of cut-outs 22. Vertical fold line 28 extends between the inner ends of the aligned continuous cut-out 22 and non-continuous cut-out 22' shown in FIG. 1. Vertical fold line 32 extends between the interior corner of cut-away section 24 and the interior end of the corresponding non-continuous cut-out 25.

FIG. 1 also illustrates "horizontal" upper fold line 34 and "horizontal" lower fold line 36 extending in continuous and straight line fashion between the blank's free side edge 38 on the left and the stepped side edge 40 on the right. As can be seen from FIG. 1, the upper and lower fold lines extend at a level commensurate with the respective interior ends of the continuous and non-continuous cut-outs 22, 22'. The fold line formation process also includes forming in blank 20 four pairs of handle bend fold lines 42 with each pair represented by two parallel, relatively short length fold lines in a close above/below relationship. The handle bend fold lines 42 extend between the tips of the U-shaped cut-outs (52, 54, 56, 58) so as to facilitate the rotation of the flap confined by the U-shaped cut-out and handle bend fold line pair.

The blank formation process also includes a perforation formation process. FIG. 1 shows perforated lines 44 and 46 formed during the perforation formation process with each of perforation lines (44, 46) extending the full width W of the original piece of material from which blank 20 is formed and thus between free blank side edges 48 and 50. To facilitate the dividing of boxes described below the perforated lines are formed so as to allow for relatively easy manual separation therealong but with sufficient strength for providing a degree of structural integrity for avoiding undesirable separation for at least the typical forces that arise during shipping and handling. While not intended to be limited to any particular length or width, an example of a suitable length for L is 63.5 inches (or about 160 cm) and for W is 21.75 inches (55 cm). For a blank having the relative length and width given in the above example and the preferred corrugated cardboard material (e.g., 42—26—42 material), a suitable perforation would include 2.5 cm length cuts separated by 1 cm length non-cut material segments.

To facilitate the discussion to follow as to the various stages of the self-dividing carton of the present invention, the various sections of blank 20 have been separately identified by way of a letter-number combination (e.g., "A1" or "a1")) with the letters representing section or section sets separated by the vertical fold lines, cut-outs and perforation lines and the numbers representing sections separated by horizontal fold lines 34 and 36. In FIG. 1 the number designations in the letter-number combinations feature "1" as the top sections, "2" as the intermediate sections, and "3" as the bottom sections. Also, a capital letter is used in the letter-number combination to represent an interior surface of a particular section (which unless covered will be an interior surface of the below described box 41) while a non-capital letter is used to denote an external side of that particular section. Where reference is made to an entire set between vertical dividing lines, reference is made to the letter alone in bold (e.g., A=A1, A2 and A3).

Figure 2:
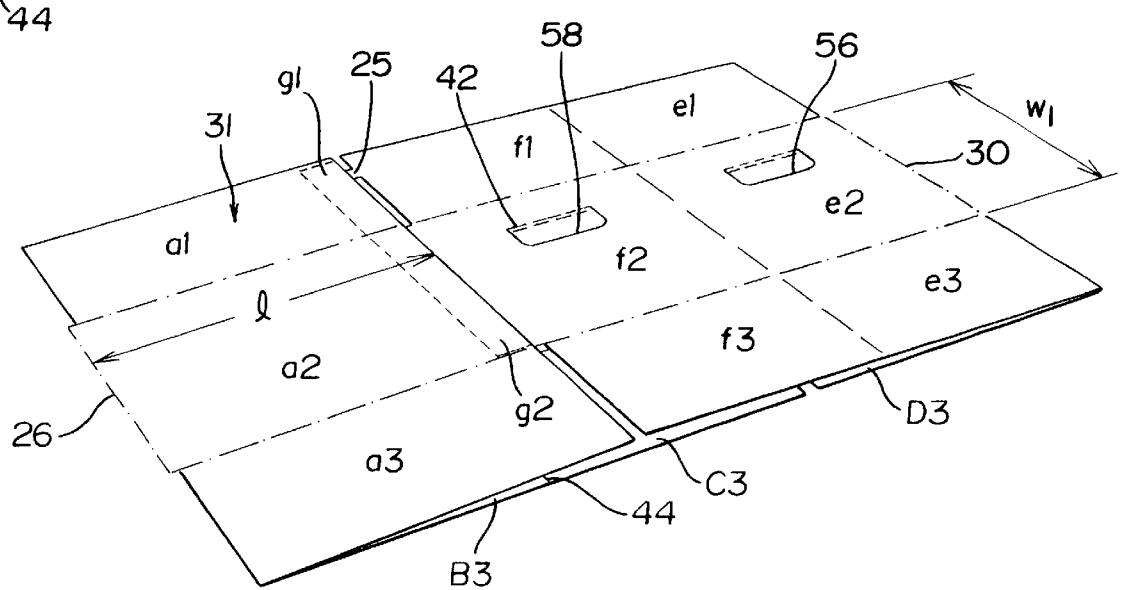
FIG. 2 illustrates the box blank of FIG. 1 in a folded and glued state.

FIG. 2 illustrates box blank 20 having been subjected to a folding and gluing process to form folded blank 31. Folded blank 31 represents an intermediate stage in going from flat blank 20 in FIG. 1 to open box 41 in FIG. 3. The preferred folding sequence in going form flat blank 20 to folded blank 41 features the rotation of section sets E, F and G in the direction of rotation arrow R1 in FIG. 1 along the pivot axis defined by fold line 30. As shown in FIG. 2 this results in exterior surfaces e and f being exposed. Also, as shown by the dot lines in FIG. 2, sections g1 and g2 (i.e., the exterior counterparts to interior sections G1 and G2) would also be exposed upon the initial inward rotation of section sets e, f and g about fold line 30. The completion of the initial fold step for these sections along fold line 30 provides a good opportunity for providing an adhesive application to the exposed section set g (i.e., g1 and g2).

Following the application of an adhesive to the exposed surfaces of sections g1 and g2, section set A is rotated in the direction of rotation arrow R2 about fold line so as to have edge portions of sections A1 and A2 come into contact with receiving, adhesive supporting portions of sections g1 and g2. As can be seen from FIG. 2, the longitudinal length l of section A is longer than the individual length of sections B, C, E and F (e.g., a 12 inch (30 cm) length for the A2 section versus a 9 inch (23 cm) length for the B2 section) resulting in folded section set A extending over and past section set B and partially over section set C. Preferably the height and length of section set A corresponds to that of section set D, and each of section sets B, C, E and F have a common length and height. The length of G is shorter than all others and of a sufficient length to provide sufficient adhesive securement when adhesive is applied thereto. Various other length relationships are also possible although the relationship described herein is preferred. Also, various other folding and adhesive application sequences and applications can be relied upon such as the application of adhesive to the edge portions of sections A1 and A2 in addition to or instead of sections g1 and g2 and, whether the folding sequence is achieved in an automated fashion or manually, the rotation of section sets E, F and G preferably occurs before or essentially contemporaneously with the rotation of section A, with sets E, F and G being rotated at least slightly ahead of section A so as to avoid having to tuck sections g1 and g2 under corresponding sections A1 and A2. The adhesive utilized is preferably of the hot melt type which quickly sets upon cooling such that folded blank 31 can quickly be subjected to the next stage of the process of going from folded blank 31 to open box 41. Depending on the type of material involved for the blank, various other securement means can be relied upon such as, for example, ultra sonic welding, laser welding, flame welding, tape, staples, or rivets.

Figure 3:
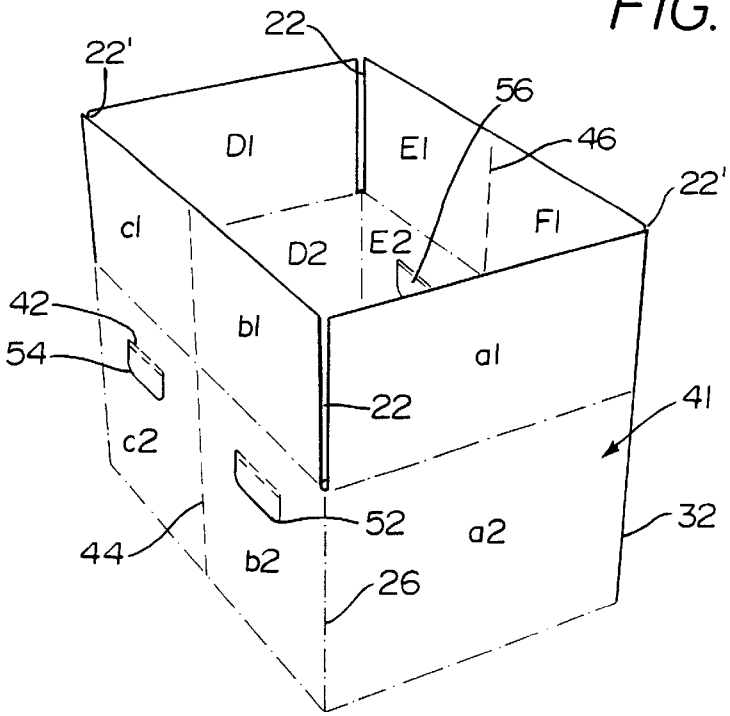
FIG. 3 illustrates an erected, open box formed from the folded and glued blank of FIG. 2.

Folded blank 31 is preferably formed at the box manufacturing plant and then shipped to the manufacturer of the product to be placed in the open box form shown in FIG. 3. The folded blank 31 is flat and sized for easy pallet or shipping container transport. This can include packaged bundles (e.g., shrink wrapped) shipped in groups such as stacked on a pallet or in one large bundle secured to a support such as a pallet through use of ties, shrink wrap or the like. Folded blanks 31 can be shipped together with the divider inserts discussed below (such as either in the same container packaging (plastic wrap) or pallet) or in a separate shipment. If shipped together, the below described two dividers per one folded blank ratio would preferably be maintained. Rather than shipping the blanks 20 in either a pre-glued or non-glued state, the box manufacturer can ship blank 20 to the product manufacturer prior to being folded or glued and the blank folded and glued by the product manufacturer. It is preferable, however, particularly when dealing with 24 packs of cans or bottles to have the folding and gluing stage conducted at the box manufacturer to have a more reasonably sized product for shipping (e.g., a 31 inch (about 80 cm) folded blank versus a 63.5 inch (about 160 cm).

From folded blank 31, open box 41 is formed as best shown in FIGS. 2 and 3. Preferably, open box 41 is erected at the product (e.g., bottle or can) manufacturers' facility. The box set up can be done by hand or more preferably by way of standard box erecting equipment. To achieve the open box 41 state from folded blank 31, the preferred process involves bringing fold lines 26 and 30, which form the side ends of folded blank 31, closer together to go from a flat state to a four sided arrangement with sections A and D representing the shorter end walls of the intermediate four sided arrangement and combined section sets B–C and E–F representing the opposing, longer side walls of the same.

Figure 4:
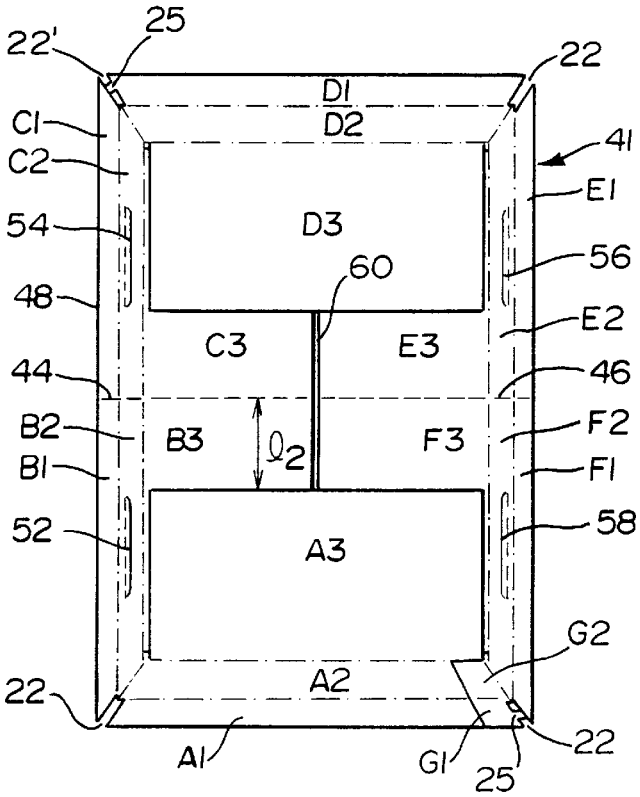
FIG. 4, illustrates a plan view of the open box of FIG. 3.

As can be seen from the top view of the erected box 41 in FIG. 4, to form the closed bottom of open box 41, sections A3 and D3 are first folded inward by 90 degrees, followed by an inward, 90 degree folding of each of section sets B3–C3 and E3–F3. To complete the bottom of box 41, glue and/or some other securement means such as staples is relied upon to secure the underside of section D3 to the contacting portions of sections C3 and E3 and, similarly, the underside of section A3 to the contacting portions of section B3 and F3. Depending on the material relied upon for forming the open box, As can also be seen from FIG. 4, sections B3, C3, E3 and F3 represent a percentage of overall width W (FIG. 1) that results in the free edges of each coming into contact or essentially into contact (e.g., 0 to 5 cm spacing) in forming the closed bottom support surface of open box 41. In FIG. 4, the combined percentage of sections B3 and F3 is essentially equal to the width of overlying section A3 leaving only a small slit 60 in the bottom of the box. Also, for product manufacturers or similar stage consumers of folded blanks who are not well equipped for applying adhesive, staples or other securement means, an alternate securement means can include adhesive strips with protective pull off covers which are preferably secured to the appropriate section to form the bottom of the box by the box manufacturer and then activated by releasing the protective cover during the time the box is being erected at the product manufacturer. From a cost standpoint it is, however, more preferable to have the product manufacturer apply a suitable adhesive such as hot melt adhesive. FIG. 4 also shows how perforation lines 44 and 46 are aligned at the halfway location for the box 41 with the free edge of A3 being spaced distance 12 from corresponding perforation lines 44, 46, with the distance 12 being the same for the distance between the free edge of section D3 and perforations (44, 46). Also while a centered set of corresponding perforations 44, 46 are shown for the preferred two equal compartment embodiment shown in FIG. 4, the present invention also features embodiments wherein the dividing line represented by perforation set 44, 46 is shifted closer to wall A2 or further from wall A2 (e.g., a ⅓–⅔ relationship). Such a modification would also involve the likely shifting in position of the handle cut-outs (e.g., a centering of the handle location between the box end wall and shifted divider perforation set) as well as the appropriate modifications in the relative dimensions of the divider blanks described below (e.g., an extension of J2 and H2 in divider 71 (FIG. 7) and a lessening in length of H2 and J2 in divider 71').

Figure 5:
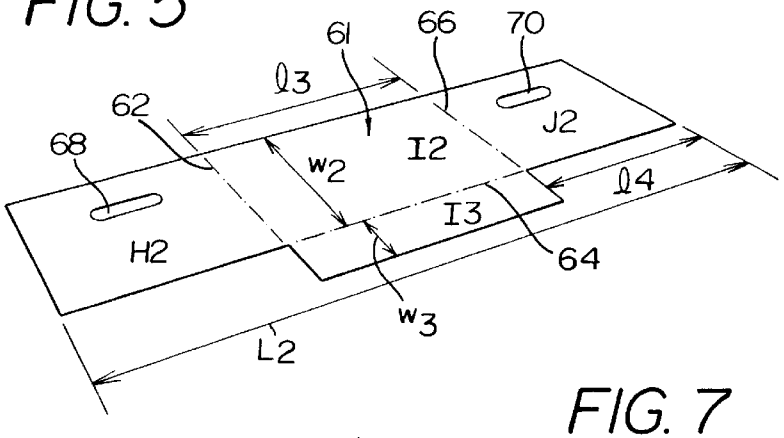
FIG. 5 illustrates one divider blank for use with the box of FIG. 3.

FIG. 5 illustrates divider blank flat 61. Since two dividers are inserted into each open box 41 (as described in greater detail below), the manufacturer of the product would have a suitable supply of divider blank flats 6 on hand with respect to the number of folded blanks 31 on hand. The dividers to be used would preferably be shipped from the box manufacturer in the flat state shown in FIG. 5. As shown in FIG. 5, divider flat blank 61 includes four sections with the number designations "2" and "3" in the letter-number combinations (e.g., "I2") generally corresponding in resultant location to that used above for section sets A–G.

FIG. 5 further illustrates divider sections H2, I2, I3 and J2 being formed by fold lines 62, 64 and 66. Length l3 of section I2 is essentially the same length as length l for A2 (e.g., 12 inches or 30.5 cm) and of a length that allows for a sliding fit relationship with respect to the side walls (with handles) of erected box 41. The width W2 of section I2 (or the height when the box is in the erected state) is preferably the same or essentially the same (e.g., within 3 cm) as that of A2 to provide a common or nearly common upper edge in erected box 41. The width W2 of I2 also represents the width of sections H2 and J2. In one embodiment of the invention width W2 is 8⅞ inches (22.5 cm) for use with open box 41 having an intermediate section width W1 of 9⅜ inches (23.8 cm).

Handle cut-outs 68 and 70 are formed in sections H2 and J2, respectively, and the length of each of H2 and J2 corresponds with B2,C2,E2 and F2 such that each of the oval-shaped cut-outs 68 and 70 are placed in alignment with a corresponding one of handle flap cut-outs 52, 54, 56 and 58 upon insertion of divider blank flats 61 as described below. Section I3 has width W3 which is lesser than that of W2 (e.g., W2:W3=2/1 to 4/1 and more preferably about 3/1).

Figure 6:
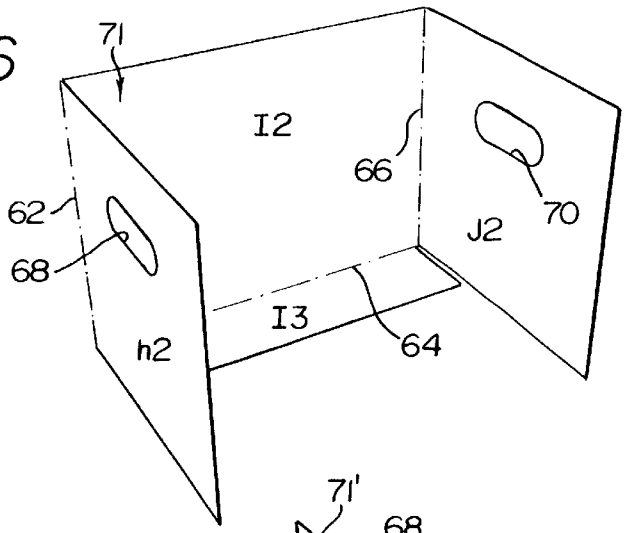
FIG. 6 illustrates, in perspective, the divider blank of FIG. 5, except in a folded, erected state.

With respect to the above noted embodiment with width W2 of 8⅞, W3 is 2.8 inches (7.2 cm). FIG. 6 illustrates the folding sequence for providing folded up divider blank 71. As shown in FIG. 6, flaps J2 and H2 are folded inward 90 degrees along edges 62 and 66 and flap I3 is rotated up 90 degrees to provide the self standing erected arrangement shown in FIG. 6.

Figure 8:
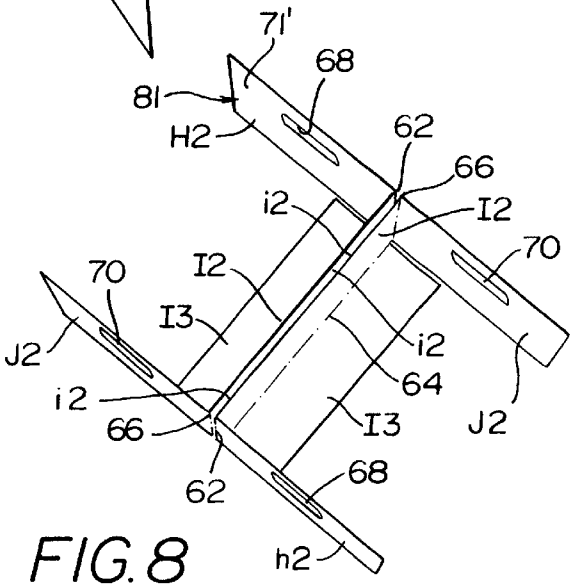
FIG. 8 illustrates a top perspective view of the combination shown in FIG. 7.
Figure 7:
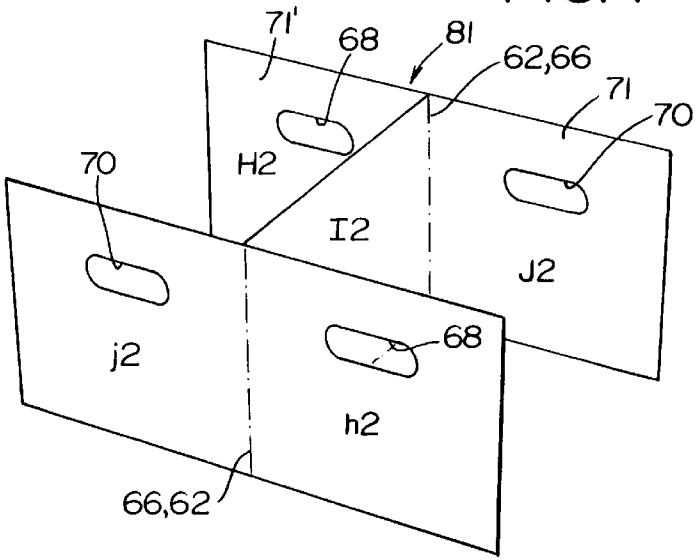
FIG. 7 illustrates, in a side perspective view, a divider blank combination comprised of two of the divider blanks shown in FIGS. 5 and 6 in a back wall/back wall abutting relationship.

FIGS. 7 and 8 show folded up divider blanks combination 81 comprised of two folded divider blanks 71,71' arranged in a juxtaposed position preferably having a contacting exterior side i2—i2 relationship as best shown in FIG. 8.

Figure 10:
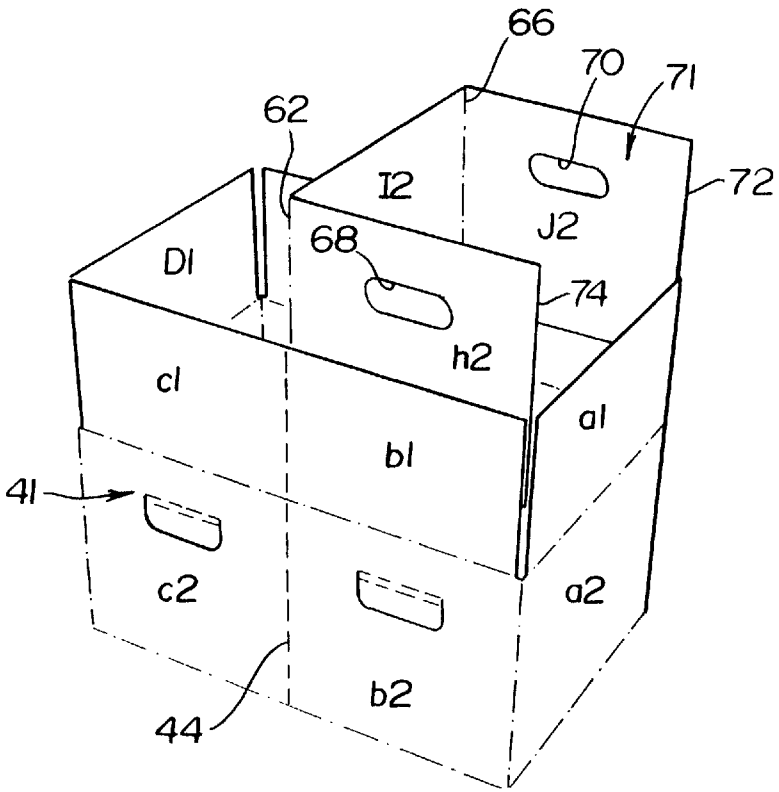
FIG. 10 illustrates the first divider shown in FIG. 9 being slidably received within the open box of FIG. 3.
Figure 9:
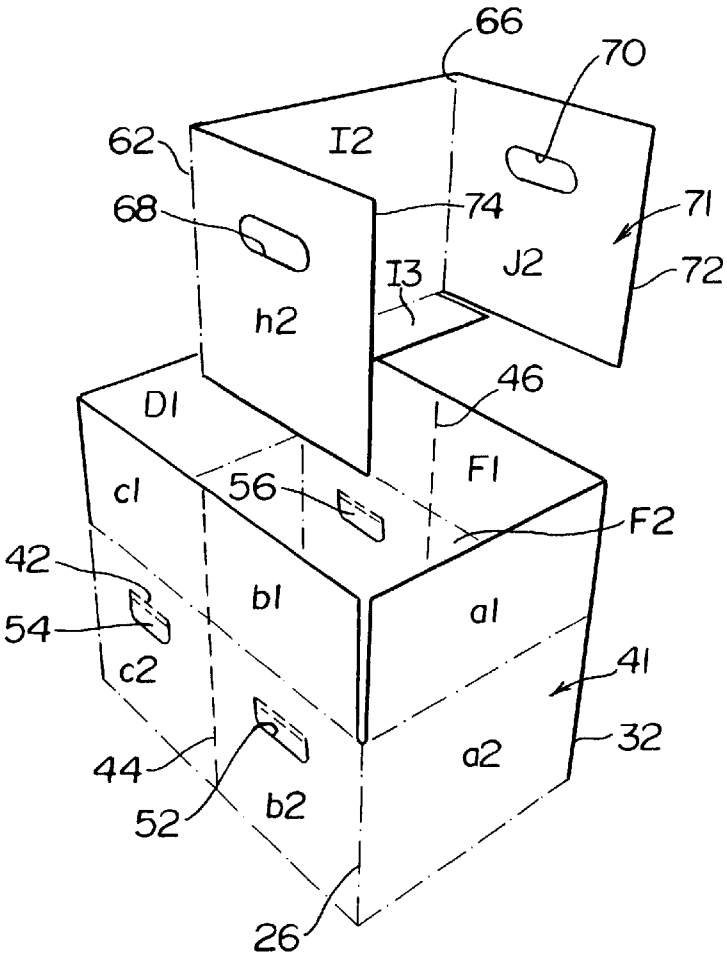
FIG. 9 illustrates an initial stage of first divider insertion into the open box of FIG. 3.

FIGS. 9–14 show a sequence of steps for placement of folded divider blanks 71, 71' into open box 41 to achieve a relationship wherein divider combination 81 is fully received by open box 41. FIGS. 9 and 10 show the orientation and insertion steps for placing folded divider blank 71 into open box 41 such that its free edges 72 and 74 are placed into or essentially into contact with the interior of open box 41 in the region of fold lines 26 and 32. Also, in the position shown in FIG. 10, exterior side section h2 of divider blank 71 is placed in sliding contact with interior side section B2 of open box 41. On the opposite side, exterior side section j2 is placed in sliding contact with interior side section F2 with edge 44 just inward or more preferably flush (preferably within 10 mm and more preferably 0–5 mm) of perforation line 44 formed in open box 41 and edge 66 is similarly placed with respect to edge 46 formed in box 41 such that the surface of section i2 of divider 71 completes a quadrangular arrangement comprised of intermediate sections b2, a2 and f2. With a flush arrangement for the surface of section i2 with respect to perforations 44 and 46 there is no appreciable extension of the newly formed free edges of sections b2 and f2 upon dividing as explained in greater detail below.

FIG. 11 shows divider 71 in its final resting position within box 41. As can be seen from FIG. 11, section I3 extends sufficiently out from vertical wall I2 so as to completely or essentially completely cover the remaining exposed portions of section B3 and F3 with the free edge 76 of section 13 contacting or essentially contacting (within 10 mm) free edge 78 of section A3 and having an exposed facing surface on a common plane with the exposed facing surface of A3. FIG. 11 also shows that oval handle hole 70 is aligned with U-shaped handle cut-outs 58 and, although not shown in FIG. 11, a similar relationship exists between oval hole 68 and handle cut-out 52. This allows for an interlocking of the outer container component of the entire container to the corresponding divider upon folding the handle cut outs through the handle hole in the corresponding divider.

Figure 13:
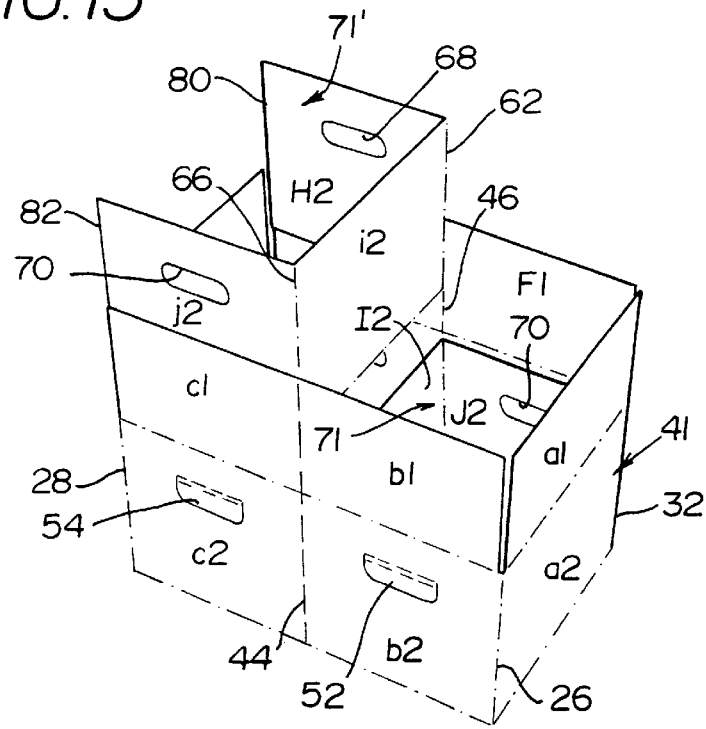
FIG. 13 illustrates the second divider being slidably received by the open box and first divider insert already positioned therein.
Figure 14:
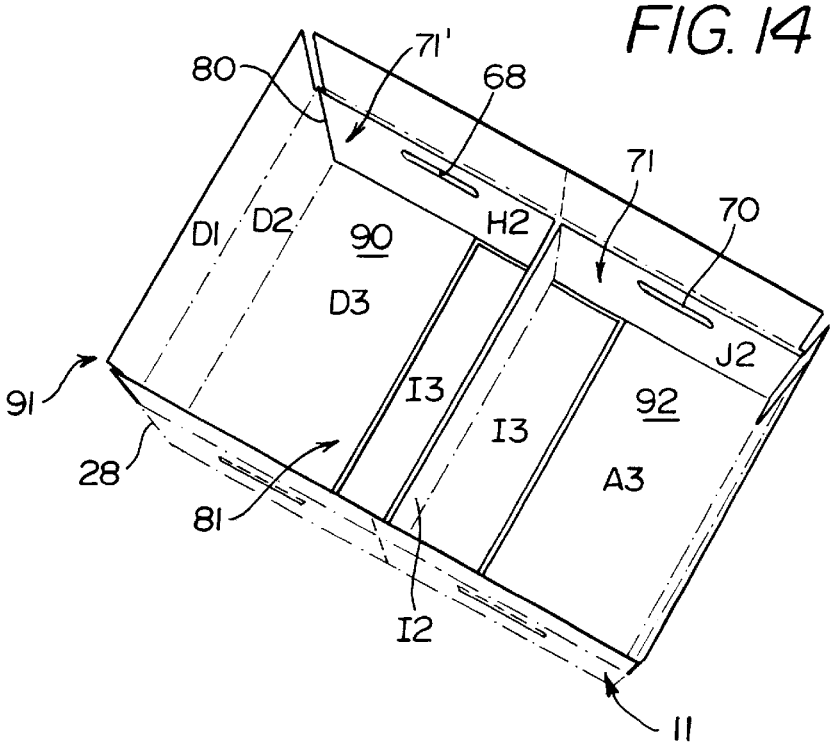
FIG. 14 illustrates a top perspective view of the open box of FIG. 3 with both the first and second dividers fully inserted.

FIGS. 12 and 13 show the orientation and insertion steps for placing folded divider blank 71' into open box 41 such that its free edges 80 and 82 are placed in, or essentially into, contact with the interior of box 41 in the region of fold lines 28 and 30. Also, in the position shown in FIG. 13, exterior side section j2 of divider blank 71' is placed in sliding contact with interior side section C2 of open box 41. On the opposite side, exterior side section h2 is placed in sliding contact with interior side section E2, with edge 66 just inward or more preferably flush (preferably within 10 mm and more preferably 0–5 mm) with respect to perforation line 44 formed in open box 41 and edge 62 is similarly placed with respect to edge 46 formed in open box 41. A preferred embodiment features section i2 of divider 71 in flush direct contact with section i2 of divider 71' and each of edges 72,74, 80 and 82 in contact with open box 41 for greatest stability. Section 13 of divider 71' covers over the portions of sections C3 and E3 not already covered by section D3 and extends into or nearly into contact with the free edge of D3 as was the case with divider 71 and the free edge of section A3. This arrangement is shown in FIG. 14 which shows combination 81 in final position with respect to open box 41 so as to provide ready to fill box 91. An advantage of the present invention is that each of dividers 71 and 71' are not secured by adhesive or the like to each other. In addition, the lower panel I3 of each of divider need not be adhered or otherwise secured to the container. The distance that I3 extends into the compartment is chosen so as to avoid any slippage out from the compartment defined by that divider either before or after the handle is moved into interlocking engagement. This mean that the dividers can quickly be slid into position without any required further adhesive securement or the like.

Figure 15:
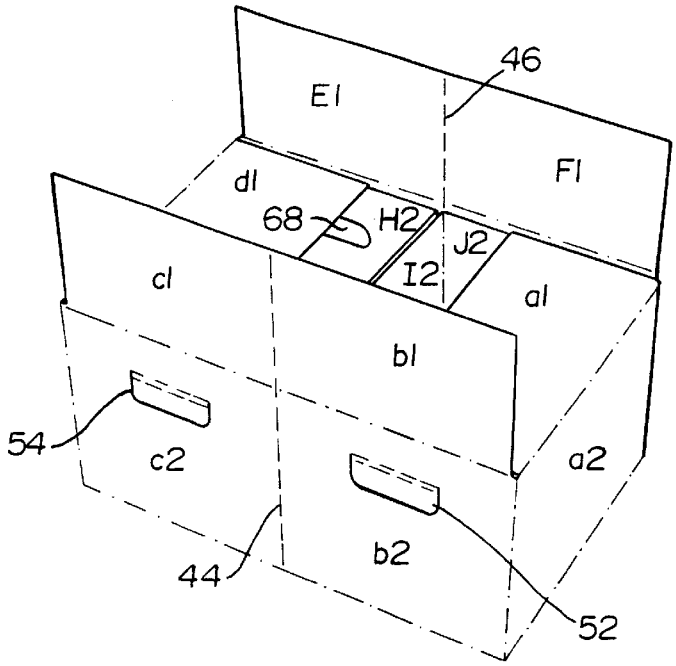
FIG. 15 illustrates the box with the divider combination inserted in the process of being closed off at the top.

The ready to fill box 91 shown in FIG. 14 is well suited for a manufacturer to place the desired product or products into each of the compartments represented by 90 and 92. For example, each compartment can receive 12 bottles or cans so as to receive a total of 24 bottles or cans in ready to fill box 91. After the products are properly positioned in box 91, the product manufacturer then seals off the box by following the top closing steps illustrated in FIGS. 15 and 16. In the top closing process, flap sections A1 and D1 are placed in a horizontal state and an adhesive is applied to the face of exterior sections a1 and d1 (and/or to the underside of the sections). This is followed by the placement of each of section sets E–F and B–C into contact with faces a1 and d1 so as to secure those section sets in place and to provide filled and ready-to-ship box 101. Various other means for securement of the upper sections to achieve the closed off box are also possible such as those earlier discussed for the bottom sections.

The ability to use standard box erecting equipment such as those provided by SALWASSER Company of Reedley, Calif., U.S.A. or ABC MACHINE CORPORATION of Tarpon Springs, Fla., U.S.A. to set up open box 41 followed by the insertion of the easily insertable dividers either manually or using an automated process provides for a complete box set-up that is faster than many prior art designs while also providing wide versatility as to the type of products that can be boxed. That is, under the present invention a wide variety of product manufacturers can rely on their standard equipment as the blank is well suited for use with such equipment despite the alterations made to provide the dividing capability (e.g., the addition of the perforations 44,46 and the addition of the handle flap members in relation to the outer box portion of a ready-to-ship box with added internal dividers).

Figure 16:
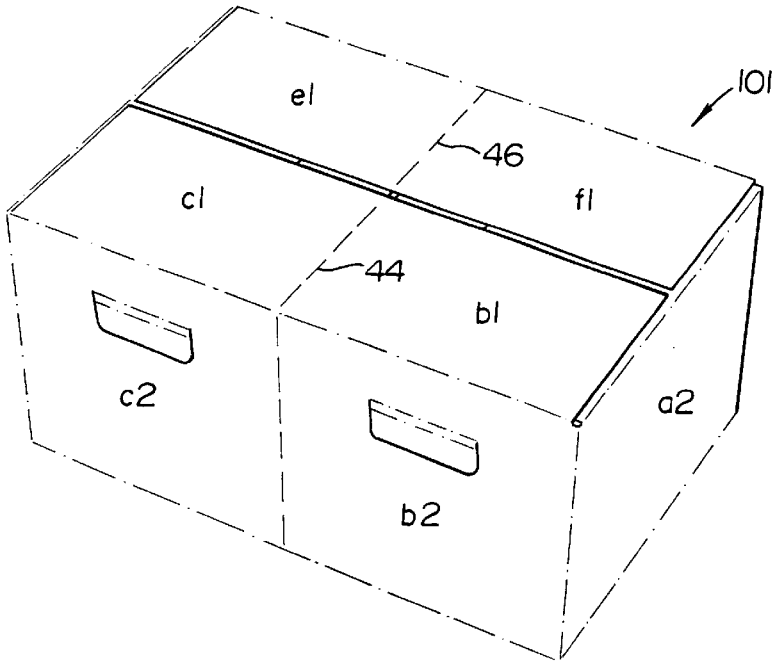
FIG. 16 illustrates the box of FIG. 15 with the top closed and sealed (e.g., glued) shut.

Ready-to-ship box 101 with its two compartment arrangement makes it easy to provide a size that is well suited for shipping to a downstream distributor, retailer or even directly to a customer with the recipient of box 101 having a variety of further handling options such as further distribution downstream in the closed, undivided state shown in FIG. 16, opening the box while maintaining the undivided state shown in FIG. 16 for access to all contained products (e.g. 24 bottles or cans), dividing the box while maintaining the closed state for further distribution in a closed state wherein the downstream recipient opens the divided box or boxes received, or dividing and opening the boxes with the opening taking place either before or (more preferably after)

splitting of the two box section. As can be seen, the versatility of the present invention makes it well suited for multiple uses and also avoids the problems of the prior art such as exposing compartments or weakening the box structure due to the splitting operation. For example, the ability to divide the box without exposing the contents is particularly useful to retailers in that retail handlers can more easily handle the weight of a divided box during activities such as shelving or stacking for display. Also, there are numerous situations where an opened full case can not be completely set out in a display or customer access area resulting in the return of an opened and weakened container to a back storage area where the products are more susceptible to damage or loss. The ability to divide up the full case while keeping one divided half unopened and fully protected and structurally intact allows a retailer to better accommodate display areas without the aforementioned environmental exposure problems. The self contained dividing ability also helps in the distribution of the appropriate number of products within a facility or defined region such as distribution of products in a hospital where there are certain products that require continuous replenishment (such as disposal products many of which are preferably left in closed containers as long as possible).

The design of the present invention is also well suited for customer manipulation to purchase only what is desired without damage to the products not presently desired for purchase. For example, a customer may desire only a 12 pack of a beverage and not a full case. With the present invention, the customer can easily carry out the dividing process made easy by the design of the present application as described in greater detail below. Furthermore the dividing process will not only readily achieve the two divided box state, but it can achieve the same without undesirable damage to the divided boxes. In addition, because the dividing process provides a clean break without damage to one or the other divided boxes, it is well suited for having preprinted product logos, information etc, applied to all of the sections, so that upon splitting the two divided boxes appear self-contained rather than split apart. For example by providing indicia on the to be exposed face surfaces of section i2 for each of dividers 71, 71', it is possible to have that indicia combine with that provided on the initially exposed surfaces on the undivided box 101 to give the appearance of a self-contained divided box as opposed to merely a segment of a larger box structure.

Figure 17:
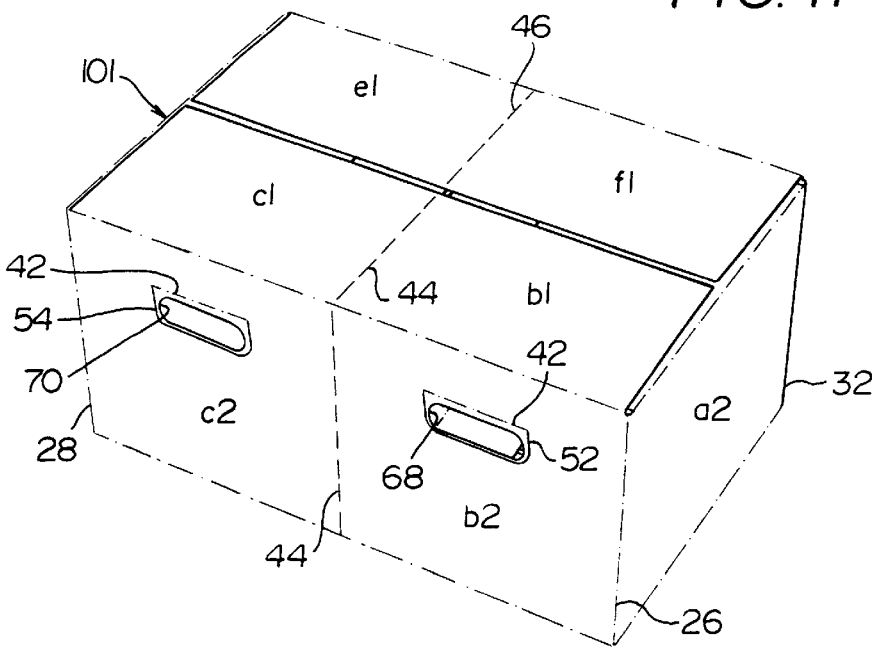
FIG. 17 illustrates the sealed box of FIG. 16 with the handle flaps pushed in to interlock the outer box with the inner dividers.

FIGS. 17–20 illustrate the process steps and box configurations involved in the dividing/separation of undivided box 101 into first divided box or carton 111 and second divided box or carton 121. FIG. 17 shows undivided box 101 in a similar state as in FIG. 16 except for the pushing in of the flaps represented by cut-outs 52, 54, 56 and 58 (only the former two are shown in FIG. 17 to be pushed in). The pushing in of the flaps involves a person rotating the cut (or perforated) flaps about the pair (or single) fold demarcation 42 until the pushed in flap extends through the corresponding oval hand cut-outs 68 and 70 formed in each of dividers 71 and 71' and lock the outer box sections to the internal dividers. Once the outer box sections are locked in position with respect to the internal dividers the next step of separation is easily accomplished.

Separation is accomplished, for example, by a person grasping the opened handles (which opening can be carried out during the grasping step and the grasping is preferably with respect to a pair of handle holes on a common side wall) and applying an opposite rotation force to at least initiate a ripping of the perforation tabs lines 44 and 46, with the rotation preferably being carried out together, at least at some point, with an outward tension applied on each side of perforation lines 44 and 46 to facilitate further ripping and separation with respect to perforation lines 44 and 46. Rotation along the perforation plane can however be solely relied upon with the arrangement of the present invention.

Instead of grasping a pair of handles to separate the two halves of undivided box 101 along perforation lines 44, 46, the person can merely push down or hold stationary a supported one of the two halves of undivided box 101 (e.g., applying a downward force on one of top section sets c1–e1 or f1–b1) and rotate and/or apply an outward force to the others until separation along perforation lines 44, 46 occurs. This alternate method of separation would be preferable for heavier containers such as a case of bottles wherein undivided box 101 need not be picked up, and the person (e.g., customer) need only to manipulate one of the two undivided box halves (particularly when there is a stack of boxes 101 which provides a customer with good positioning for easy separation due to the avoidance of having to bend over and pick up the undivided box).

Upon completion of the separation process, two self-contained, completely closed off cartons or boxes are formed (i.e., first divided carton 111 and second divided carton 121). First and second divided cartons 111, 121 are shown in FIG. 18 in the separated state.

Figure 18:
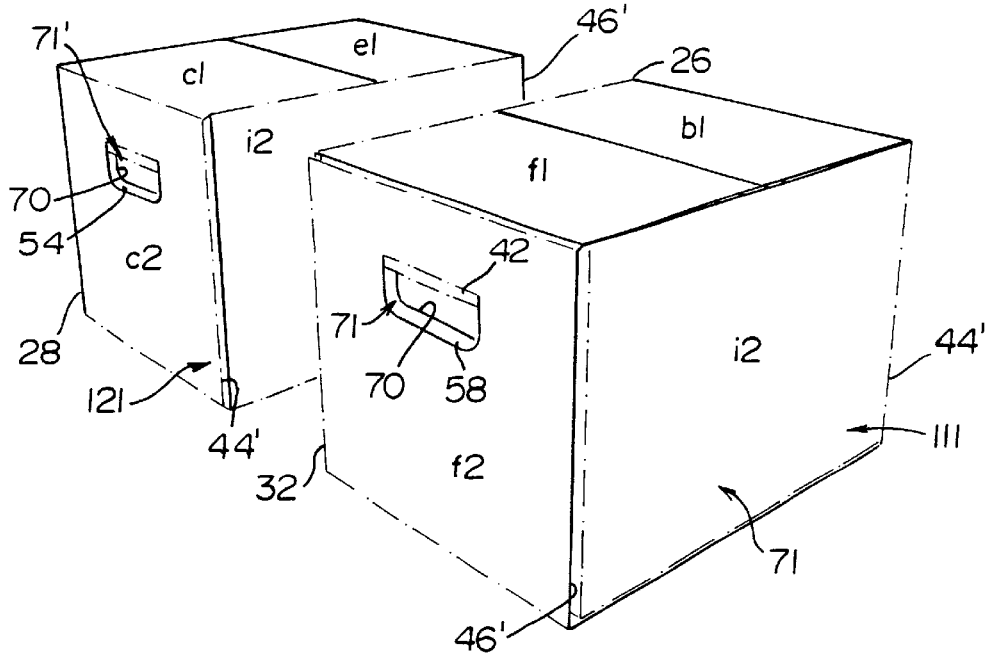
FIG. 18 illustrates the dividing and separation of the undivided box of FIG. 17 into first and second divided boxes or cartons with the closer of the two having been rotated to illustrate the formerly internally positioned back wall of the first divider.

In FIG. 18, first divided carton 111 is shown rotated from its initial connection location to illustrate the newly exposed section i2 of divider 71. FIG. 18 also illustrates handle cut-out 70 in divider 71 upon rotation of the handle flap about fold set 42.

Figure 19:
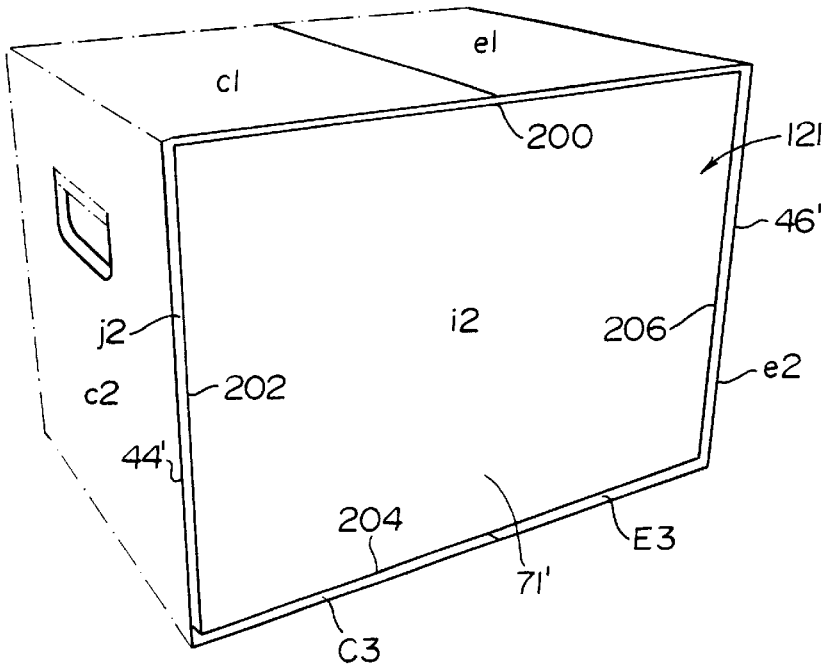
FIG. 19 provides a more detailed and slightly enlarged view of the divided box or carton that is furthest from view in FIG. 18.

FIG. 19 provides a more detailed view of divided carton 121 wherein the section i2 of divider 71' goes from an internal wall of undivided box 121 to an external wall of second divided carton 121 with free top edge 200, folded side edge 202 (i2–j2), folded bottom edge 204 (i2–j2) and folded side edge 206 (i2–h2). The folded and free edges of i2 for divider 71 are bordered and essentially flush with the edges 44' and 46' resulting from the split along perforation lines 44, 46, the free edge of section c1 and e1 on the top, and the free edge of section c3 and e3 on the bottom. A similar situation exists with respect to first divided carton 111.

Figure 20:
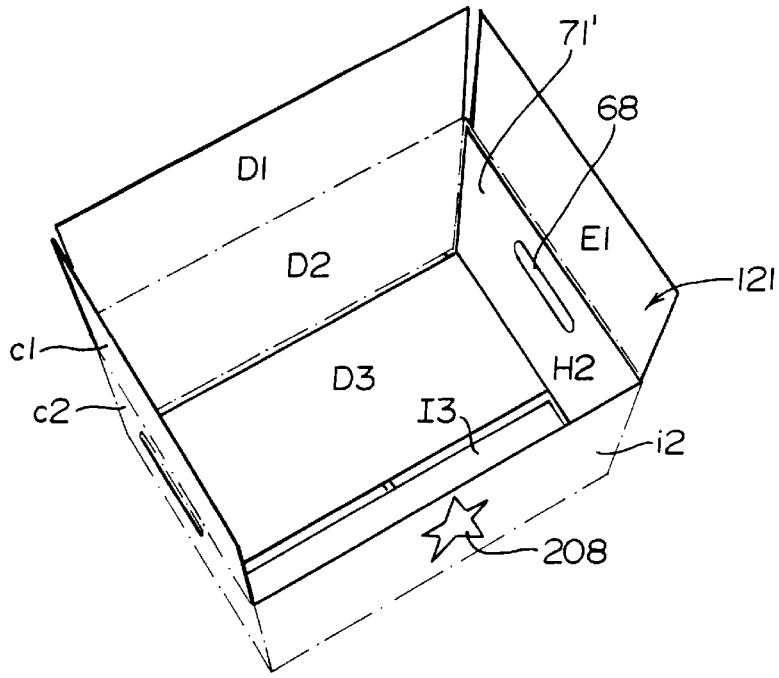
FIG. 20 shows a top perspective view of the box in FIG. 19 following an opening of the top.

FIG. 20 shows first carton 121 having gone from the closed state in FIG. 18 to an open (product (not shown) accessible) state in FIG. 20. With the use of a suitable adhesive, a person can pull sections c1 and e1 open from their adhesive bond contact with d1, whereupon d1 can then be flapped open to obtain full product access. FIG. 20 also includes indicia example 208 which can be applied by the box manufacturer or product manufacturer while the divider blank 61 is in a flat state. Indicia 208 would be hidden from view with respect to undivided box 101, but would be viewable upon separation such that an exposed, not as attractive surface can be avoided upon separation.

Figure 21:
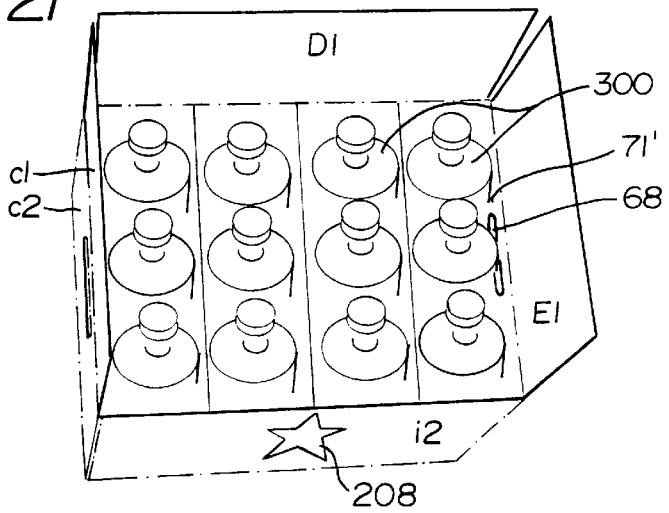
FIG. 21 shows a top perspective view of the box in FIG. 20 prior to removal of its contents which in this example features twelve 20 oz glass bottles in a relatively snug relationship (sufficient body-to-body contact to avoid undue shifting).

FIG. 21 shows a view similar to that of FIG. 20 except FIG. 20 illustrates divided carton 121 after product removal (to facilitate an understanding of the internal make up of carton 121) and FIG. 21 shows an example of divided carton prior to product removal. In FIG. 21 there is shown product 300 which in this instance is individual 20 oz glass bottles. The relative size of carton 121 provides for twelve of these bottles in a rather snug or body-to-body contact relationship to prevent too much movement during shipping. The bottles shown in FIG. 21 have large base sections leading to smaller diameter neck regions. Thus, with this shape there is provided sufficient room for the passage of the handle flaps into locking engagement with the dividers (the handles preferably being within the upper 50% of the intermediate section in which they are formed and more preferably having a center at about 25% to 30%, with respect to the full intermediate section height, down from the intermediate top edge). A preferred arrangement features handles which have an upper edge down about 2 inches from the intermediate section's top edge, a vertical thickness of about 1.5 inches, and a horizontal 1 length of about 3.5 inches. If the products are full length cylinders or some other shape that does not readily allow for handle flap passage when in a state of relatively tight body-to-body contact, then there is provided some degree of freedom of movement of the internal products to provide room for flap passage during the divider locking step.

The first divider carton would preferably be used to provide the same product containment as the illustrated second carton so as to have the undivided box support a total of twenty-four 20 oz bottles. The present invention is, however, highly versatile, and can be used to support a wide variety of products and a wide number range for those products including an unequal number of products (with the same compartment size or different size compartments) and in a variety of situations such as loose packing to tight packaging. Although not shown protective inserts or the like or other protective means (e.g. foam inserts) can also placed prior to open box sealing so as to protect the products during shipping or handling.

Figure 22:
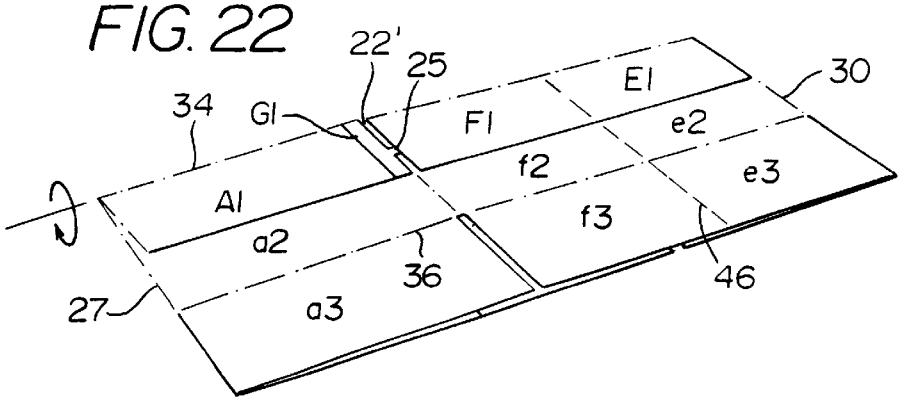
FIG. 22 shows an optional folding arrangement for the present invention wherein the folded and glued blank of FIG. 2 has its top flaps folded back prior to box folding to facilitate maintenance of the top flaps out of the way during subsequent divider and product insertion.

FIG. 22 shows an optional folding arrangement for the present invention wherein the folded and glued blank of FIG. 2 has its top flaps folded back (about 180 degrees into contact with the exterior of the intermediate section) prior to box folding. As can be seen in FIG. 22, because the tabs 25 are provided only within slots 22' formed between section set A–F and section set C–D. 22, it is possible to rotate these sections sets down into the position shown in FIG. 22 without a disruption of the tabs.

Figure 23:
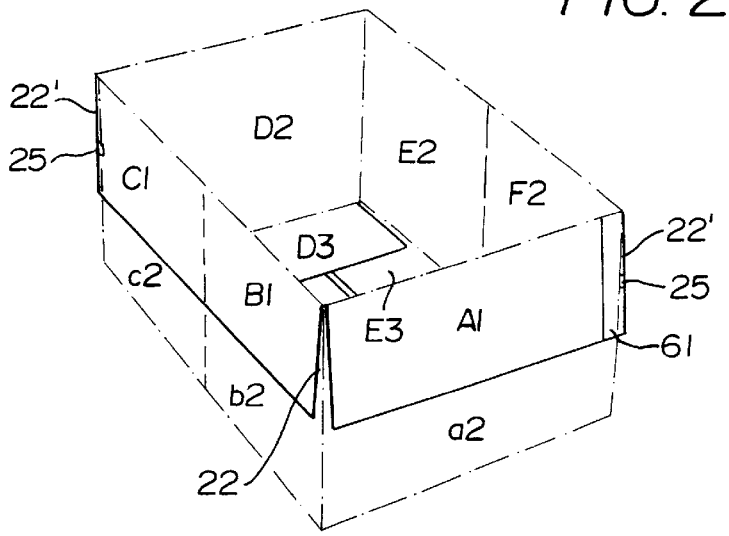
FIG. 23 shows the folded blank of FIG. 2 after having been subjected to a manual or automated box erecting procedure.

FIG. 23 shows the folded blank of FIG. 2 after having been subjected to a manual or automated box erecting procedure. As can be seen in FIG. 23, despite the box formation tabs 25 remain intact and help hold down the flaps to keep them out of the way during insertion of the dividers and the insertion of the product with the dividers preferably being inserted first but the reverse order also being possible but less preferable particularly when the product is tightly packed within the undivided box.

To provide a one step insertion process and position relationship maintenance with respect to divider combination 81 during insertion into open box 41, there can be provided an easy release, temporary connection between dividers 71, 71' through use of, for example, an easy release adhesive (a low release threshold tacky material) or a non locking, but position maintaining protrusion/cavity-depression relationship with respect to walls i2—i2 of dividers 71,71'. Since, however, the illustrated arrangement of the present invention has worked well for its intended purposes, the flush but not in any way connected relationship of the present invention is deemed more preferable as, for example, it avoids extra process steps, additional material, and added costs.

Although the present invention has been described with reference to preferred embodiments, the invention is not limited to the details thereof. Various substitutions and modifications will occur to those of ordinary skill in the art following a review of this application, and all such substitutions and modifications are intended to fall within the spirit and scope of the invention as defined in the appended claims.

What is claimed is:

1. A dividable container for storing articles, comprising:

an outer container component having a top section, bottom section and an intermediate section, said intermediate section having separation facilitation means;

a first divider, said first divider being positioned with respect to said separation facilitation means so as to form, upon separation of said outer container component along said separation facilitation means, a first sub-container that has an intermediate wall comprised of a first portion of said first divider and a portion of said intermediate section, said outer container component including an engagement member which is adjustable from a non-engage state to an engage state, and said first divider having an engagement member reception section, whereby said reception section is positioned so as to receive said engagement member while in said engage state so as to interlock said outer container component to said first divider.

2. A dividable container as recited in claim 1, further comprising a second divider with said first divider having a back wall in a flush or essentially flush arrangement on a first side of said separation facilitation means and said second divider having a back wall in a flush or essentially flush arrangement with respect to a second side of said separation facilitation means.

3. A dividable container as recited in claim 2 wherein said first and second dividers have back walls that are flush and in contact with each other.

4. A dividable container as recited in claim 1, further comprising a second divider and said first and second dividers each include a back wall, two side walls and a bottom wall, and said outer container component having two side walls forming a portion of said intermediate section, and said outer container component comprising a plurality of engagement members for interlocking said first and second dividers to said outer container component.

5. A dividable container as recited in claim 4 wherein said engagement members include flaps foldable through reception openings formed in said side walls of said first and second dividers.

6. A dividable container as recited in claim 4 wherein said back walls of said first and second dividers are free from connection with one another.

7. A dividable container as recited in claim 4 wherein said side walls of said first and second dividers are in contact with corners defined by the intermediate section of said outer container component.

8. A dividable container as recited in claim 7 wherein the back walls of said first and second dividers are in a contact relationship.

9. A dividable container as recited in claim 1 wherein said divider is in contact with said outer container component but free from securement with said outer container component.

10. A dividable container as recited in claim 1 wherein said engagement member is a flap and said reception section is a hole formed in said first divider through which said flap extends when going from said non-engaged state to said engaged state.

11. A dividable container, comprising:

an outer container component having a bottom section, an intermediate section, which includes two opposing side walls and two opposing end walls, and a top cover, said outer container component having a perforation line which is positioned so as to extend about the opposing side walls, top cover and bottom section so as to provide two sub-container components upon separation along said perforation line, and said side walls further comprising handle flap sections;

a first divider and a second divider, each of said dividers including a back wall, a pair of side panels spaced apart by said back wall and a bottom segment, the first divider having a back wall flush or essentially flush with the perforation line and a handle reception opening for reception of a handle flap from one of said handle flap sections, and said second divider having a back wall flush or nearly flush with the perforation line and on an opposite side of said perforation line as that of said first divider, and said second divider including a handle reception opening for reception of a handle flap from another of said handle flap sections.

12. A dividable container as recited in claim 11 wherein said dividers are free from securement with respect to said outer container when said handle flaps are not engaged.

13. A dividable container as recited in claim 11 wherein said outer container component is formed from a single blank having a plurality of top segments, intermediate segments and bottom segments separated by fold lines and cut-outs, and said perforation line extends from a top edge to a bottom edge of said blank across a vertically aligned set of one of said top, intermediate and bottom segments.

14. A dividable container as recited in claim 11 wherein said divider are in an abutting relationship with each other and with said outer container component.

15. A method of disassembling the dividable container of claim 11 further comprising inserting the handle flap of one of said handle flap sections into an adjacent one of said handle reception openings and separating the dividable container along the perforation line so as to form two four walled sub-containers.

16. A single divider blank for folding and insertion in a dividable container assembly, said single divider blank consisting essentially of four segments which segments are a back wall, two side wall segments extending from opposite ends of said back wall segment, and a bottom segment extending off from a bottom edge of said back wall segment, and said divider further comprising a handle reception opening formed in one of said side wall segments.

17. A divider for use in a dividable container assembly, said divider comprising, a back wall, two side walls extending from opposite ends of said back wall, and a bottom segment extending off from a bottom edge of said back wall, and said divider further comprising a handle reception opening formed in one of said side walls, wherein said bottom wall extends out from said back wall to a lesser extent than said side walls.

18. An outer container component blank for use in a self-dividing container, said blank having a series of upper, intermediate and bottom segment sets, with said sets being separated by folds at the intermediate level and separated by cut-outs at the top and bottom level with said cut-outs being in vertical alignment with respective fold lines in said intermediate segments, and said intermediate level including handle flaps and said blank further comprising a perforation that extends across one of said sets, and said blank includes a pair of perforations extending along parallel lines that are separated by at least one fold line, and there are two pairs of handle flap sections in said blank separated by at least one fold line.

19. A blank as recited in claim 18 wherein said intermediate segments include a glue tab segment at a free end of said blank.

20. A method of assembling a self dividing box, comprising erecting an outer container compartment from a blank having a first handle flap portion formed therein, such that the erected outer container compartment has an enclosed bottom, an interconnected intermediate section and an open top section, and said intermediate section having separation means;

inserting a first divider having a bottom segment, back wall, a pair of side panels extending from said back wall and a flap reception opening such that the flap reception opening of said first divider is placed in a handle flap reception position with respect to said handle flap portion.

21. A method of assembling claim 20 further comprising inserting a second divider having a bottom segment, a back wall, a pair of side panels and a flap reception aperture such that the flap reception aperture of said second divider is placed in a handle flap reception position with respect to a second handle flap portion of said blank, and said inserting of said second divider includes placing the back walls of said first and second dividers in a flush relationship with the separation means being a perforation line aligned with said back walls.

22. A dividable container for storing articles comprising:

an outer container component having a top and bottom, end walls, and front, and rear wall portions, the top and bottom each comprising pairs of longitudinal and transverse flaps wherein the transverse flaps are turned inwardly from the end walls and the longitudinal flaps are turned inwardly from the front and rear wall portions, the front and rear walls, and top and bottom longitudinal flaps having perforations providing a line of separation into two containers, the front and rear wall portions further having foldable handle portions located on each side of the line of separation; and a divider device contained within the outer container component, the divider device having separate sections positioned back-to-back along the line of separation, each section having a transverse wall and side walls, the side walls lying along and inside the front and rear walls of the outer container component, the side walls further having cutout openings corresponding in configuration and location to the foldable handle portions of the outer container component so that the outer container component handle portions may be folded inward through the corresponding cutout openings to interlock the outer container component to the divider device, whereby the outer container component may be readily divided at will along the line of separation into two containers in which each transverse wall of the divider device forms a new outer end wall.

23. The container of claim 22 in which the divider device sections further have a bottom flap extending from the transverse wall and positioned on top of the bottom of the outer container component.

24. The container of claim 23 in which the outer container component end wall flaps form inner flaps of the bottom of the outer container component, with said inner flaps being less than half the length of the undivided front and rear walls, the bottom flaps of the divider device sections being sized so that they essentially abut the end wall flaps positioned as inner flaps of the outer container component.

* * * * *